US010132063B2

(12) United States Patent
Nagayanagi et al.

(10) Patent No.: US 10,132,063 B2
(45) Date of Patent: Nov. 20, 2018

(54) WATER DISCHARGE DEVICE AND BATHTUB FITTING

(71) Applicant: LIXIL Corporation, Tokyo (JP)

(72) Inventors: Masako Nagayanagi, Tokyo (JP); Mayumi Idota, Tokyo (JP); Yuichiro Ichikawa, Tokyo (JP); Masashi Kawakami, Tokyo (JP)

(73) Assignee: LIXIL CORPORATION, Tokyo (JP)

( * ) Notice: Subject to any disclaimer, the term of this patent is extended or adjusted under 35 U.S.C. 154(b) by 0 days.

(21) Appl. No.: 15/363,933

(22) Filed: Nov. 29, 2016

(65) Prior Publication Data

US 2017/0081831 A1 Mar. 23, 2017

Related U.S. Application Data

(63) Continuation of application No. PCT/JP2015/065260, filed on May 27, 2015.

(30) Foreign Application Priority Data

May 30, 2014 (JP) ..... 2014-113316

(51) Int. Cl.

| | |
|---|---|
| ***E03C 1/04*** | (2006.01) |
| ***A47K 3/02*** | (2006.01) |
| ***B05B 1/04*** | (2006.01) |
| ***B05B 17/08*** | (2006.01) |
| *B05B 1/22* | (2006.01) |

(52) U.S. Cl.

CPC ..... *E03C 1/0404* (2013.01); *A47K 3/02* (2013.01); *B05B 1/044* (2013.01); *B05B 17/085* (2013.01); *B05B 1/22* (2013.01)

(58) Field of Classification Search

CPC ..... A47K 3/28

USPC ..... 4/541.6

See application file for complete search history.

(56) References Cited

FOREIGN PATENT DOCUMENTS

| | | | |
|---|---|---|---|
| CN | 102206946 | A | 10/2011 |
| CN | 104941825 | A | 9/2015 |
| DE | 6929123 | U | 11/1969 |
| DE | 1658244 | A1 | 9/1970 |
| DE | 2554723 | A1 | 6/1977 |
| EP | 0275084 | A2 | 7/1988 |

(Continued)

OTHER PUBLICATIONS

International Search Report from International Application No. PCT/JP2015/065260, dated Aug. 18, 2015.

*Primary Examiner* — Lori Baker

(74) *Attorney, Agent, or Firm* — Muncy, Geissler, Olds & Lowe, P.C.

(57) ABSTRACT

A water discharge device comprising a water discharge member formed with a slit-like discharge port and a discharge path, wherein the discharge path is formed with a reservoir chamber for holding, as reserve water, water flowing into the discharge path from its upstream side, and is formed with a constricting flow path that sends forth the reserve water in the reservoir chamber to the discharge port, and lateral surfaces on either side of the discharge path in its width direction are formed such that a path width of the discharge path spreads as approaching its discharge port side from its reservoir chamber side, and is formed such that the angle formed by an imaginary line paralleling the width direction of the discharge port and, on the lateral surfaces, a tangent line passing over the discharge port's opening rim is greater than or equal to 45° and less than 90°.

6 Claims, 13 Drawing Sheets

(56) References Cited

FOREIGN PATENT DOCUMENTS

| | | | |
|---|---|---|---|
| FR | 2333578 | A1 | 7/1977 |
| JP | S63-247433 | A | 10/1988 |
| JP | H02-144059 | U | 12/1990 |
| JP | 2002-153391 | A | 5/2002 |
| JP | 2011087921 | | 5/2011 |
| JP | 2013-144093 | A | 7/2013 |

COMPARATIVE EXAMPLE

WATER DISCHARGE DEVICE AND BATHTUB FITTING

BACKGROUND OF THE INVENTION

1. Field of the Invention

The present invention relates to water discharge devices, and to bathtub fittings furnished therewith, for discharging water in film form.

2. Description of the Related Art

Water discharge devices for discharging water in film form (hereinafter referred to as film-like water) have been known to date (for example, reference is made to JP 2002-153391 A). The devices are installed on an upper portion of a bathtub, and are configured to be capable of discharging the film-like water toward the inner side of the bathtub. The water flow cascading waterfall-like from the water discharge devices is aesthetically outstanding, and moreover, because it, e.g., casts the film-like water onto bather's shoulders, yielding relaxation effects, it contributes to the incitement of user purchasing desire.

Patent Document 1: JP 2002-153391 A

In that connection, film-like water discharged from this type of water discharge device is known to be prone to lose its form. The present inventors came upon recognition that there is room for further improvement in the structure of conventional water discharge devices in order to suppress this form loss.

SUMMARY OF THE INVENTION

The present embodiment has been brought about in view of issues such as these, and an object thereof is, when discharging film-like water from a discharge port, to suppress its form loss.

In order to solve the above problem, an embodiment of the present invention relates to a water discharge device. The water discharge device for discharging water in film form, comprising a water discharge member formed with a slit-like discharge port and a discharge path for delivering water to the discharge port, wherein the discharge path is formed with a reservoir chamber for holding, as reserve water, water flowing into the discharge path from its upstream side, and is formed with a constricting flow path that sends forth the reserve water in the reservoir chamber to the discharge port, and lateral surfaces on either side of the discharge path in its width direction are formed such that a path width of the discharge path spreads as approaching its discharge port side from its reservoir chamber side, and is formed such that the angle formed by an imaginary line paralleling the width direction of the discharge port and, on the lateral surfaces, a tangent line passing over the discharge port's opening rim is acute and greater than or equal to 45° and less than 90°.

Another embodiment of the present invention relates to a bathtub fitting. The bathtub fitting includes the water discharge device according to the above embodiment and a bathtub on which the water discharge device is installed.

DETAILED DESCRIPTION OF THE INVENTION

The invention will now be described by reference to the preferred embodiments. This does not intend to limit the scope of the present invention, but to exemplify the invention.

First, basic contents that have been considered before the present invention has been conceived of will be explained.

Figure 1A:
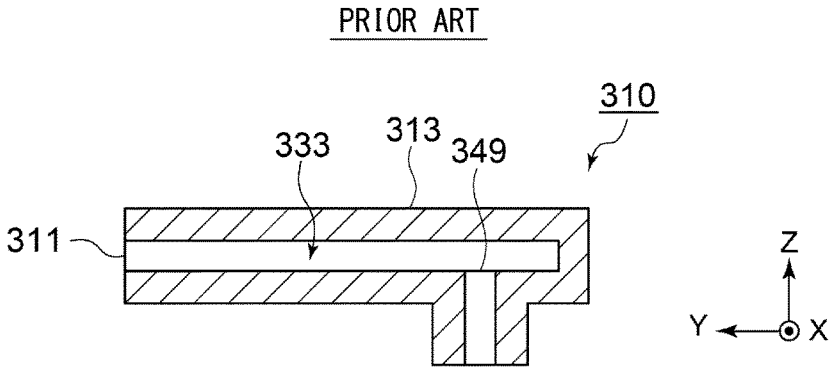
FIG. 1A is a sectional side view illustrating a conventional water discharge device.
Figure 1B:
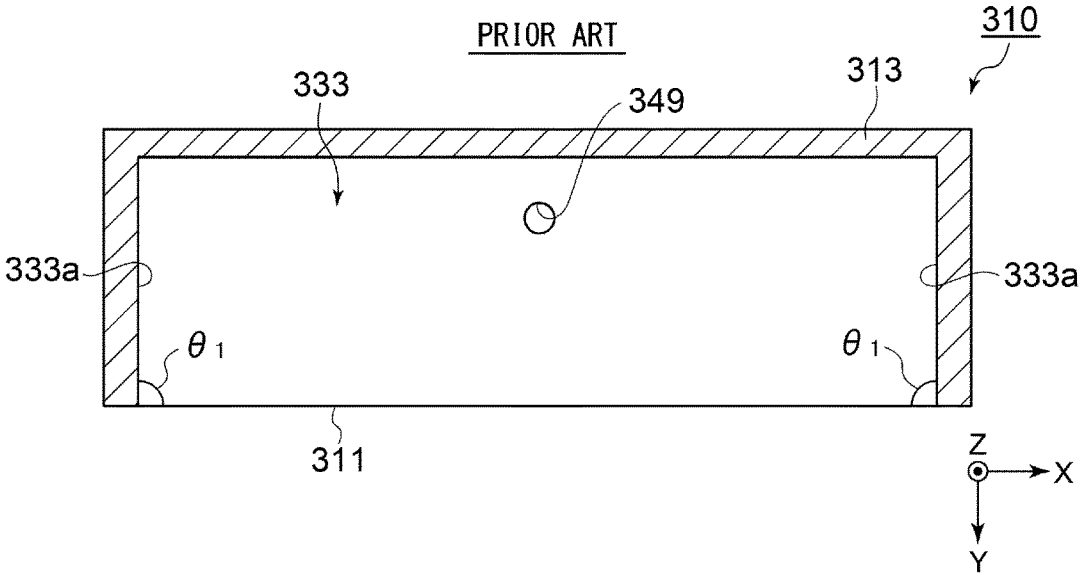
FIG. 1B is a sectional plan view thereof.
Figure 1C:
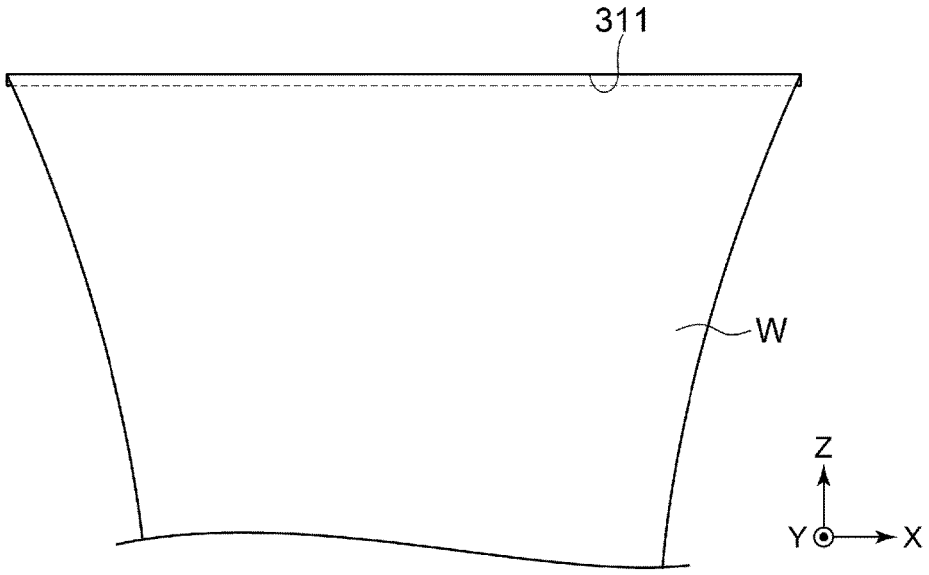
FIG. 1C is a front view illustrating film-like water discharged from the water discharge device.

FIGS. 1A and 1B are a sectional side view and a sectional plan view illustrating a conventional water discharge device 310, and FIG. 1C is a front view schematically illustrating film-like water W discharged from the water discharge device 310.

The water discharge device 310 includes a water discharge member 313. The water discharge member 313 is formed with a slit-like discharge port 311 and a discharge path 333 for delivering water to the discharge port 311. An inlet 349 is formed on the inner surface of the discharge path 333. When water is pumped into the discharge path 333 through the inlet 349, the water discharge member 313 discharges film-like water W having a wide width from the discharge port 311. In the following explanation, a direction in which the discharge port 311 extends will be referred to as a left-and-right direction X, a horizontal direction perpendicular thereto will be referred to as a front-and-rear direction Y, and a vertical direction will be referred to as an up-and-down direction Z.

In this case, when water flows in through the inlet 349, a disturbance occurs in a water flow provided into the discharge path 333 due to a rapid change in a cross section of a flow path. The water flow discharged from the discharge port 311 is affected by this disturbance occurring when flowing in from the inlet 349, and a velocity of the flow varies. This makes film-like water W more likely to lose its form.

In order to discharge the wide film-like water W, the discharge path 333 has a wide and flat shape of which a path width is wide and of which a path height is low, and accordingly, a thickness of the water flow flowing the inner side thereof becomes also thin. Therefore, the water flow discharged from the discharge port 311 is likely to be affected by turbulence in the discharge path 333 and a foreign object stuck in the discharge path 333, and so on. Therefore, the velocity of the flow is also likely to vary because of this point.

Further, a distance from the inlet 349 to the discharge port 311 varies depending on a widthwise position of the discharge port 311. The larger a width length of the film-like water W is, the larger a difference between the minimum value and the maximum value of the aforementioned distance is likely to be. Therefore, as the width length of the film-like water W becomes wider, the velocity of the water flow discharged from the discharge port 311 is more likely to vary depending on its widthwise position, and the film-like water W is more likely to lose its form.

Furthermore, surface tension is applied to the film-like water W discharged from the discharge port 311. Therefore, because of the surface tension, the film-like water W is likely to be narrowed so as to reduce its width length as it gets away from the discharge port 311.

Therefore, as a first technique, the inventors of the present application have made a discharge path formed with a reservoir chamber for holding, as reserve water, water flowing into the discharge path from its upstream side and a constricting flow path for sending forth the reserve water in the reservoir chamber to the discharge port. Accordingly, the velocity of the water flowing in the reservoir chamber from the upstream side is lower than the case where a path height of the discharge path is at a constant level, and the flow is effectively straightened such that the velocity of the water in the discharge path becomes uniform in the width direction. As a result, the velocity of the water flow discharged from the discharge port can be more easily made uniform in the width direction, so that the form loss of the film-like water can be suppressed.

Further, as a second technique, the inventors of the present application make a discharge path formed such that a path width of the discharge path spreads as approaching its discharge port side from its reservoir chamber side. Accordingly, a water flow flows along a lateral surface of the discharge path, and a velocity component directed to the outer side in the width direction can be included in water flow discharged from either end portion of the discharge port in the width direction. As a result, a time when the film-like water starts to become narrow due to the surface tension can be delayed, and narrowness of the film-like water can be suppressed within a wide range from where water is discharged from the discharge port to where water comes in contact with the water surface.

Here, as a result of experimental considerations by using the water discharge device having the above techniques, the inventors of the present application has obtained knowledge as a further new problem to be solved. This knowledge is that, when a degree of spreading of the path width of the discharge path is too large, the film-like water discharged from the discharge port may be divided in the width direction. This may be because when the velocity component, directed to the outer side of the width direction, of the water flow discharged from either end portion of the discharge port in the width direction becomes excessively large, water flows discharged from either end portion in the width direction is likely to be separated from a water flow discharged from a middle portion in the width direction.

In the course of solving this problem, the inventors of the present application have obtained knowledge. This knowledge is that, when angles formed by the lateral surfaces on either side of the discharge path in the width direction is within a predetermined range, separation of the film-like water can be suppressed easily while the narrowness of the film-like water is suppressed, and form loss of the film-like water can be suppressed. Hereinafter, the details of embodiments according to the present invention will be explained.

First Embodiment

Figure 2:
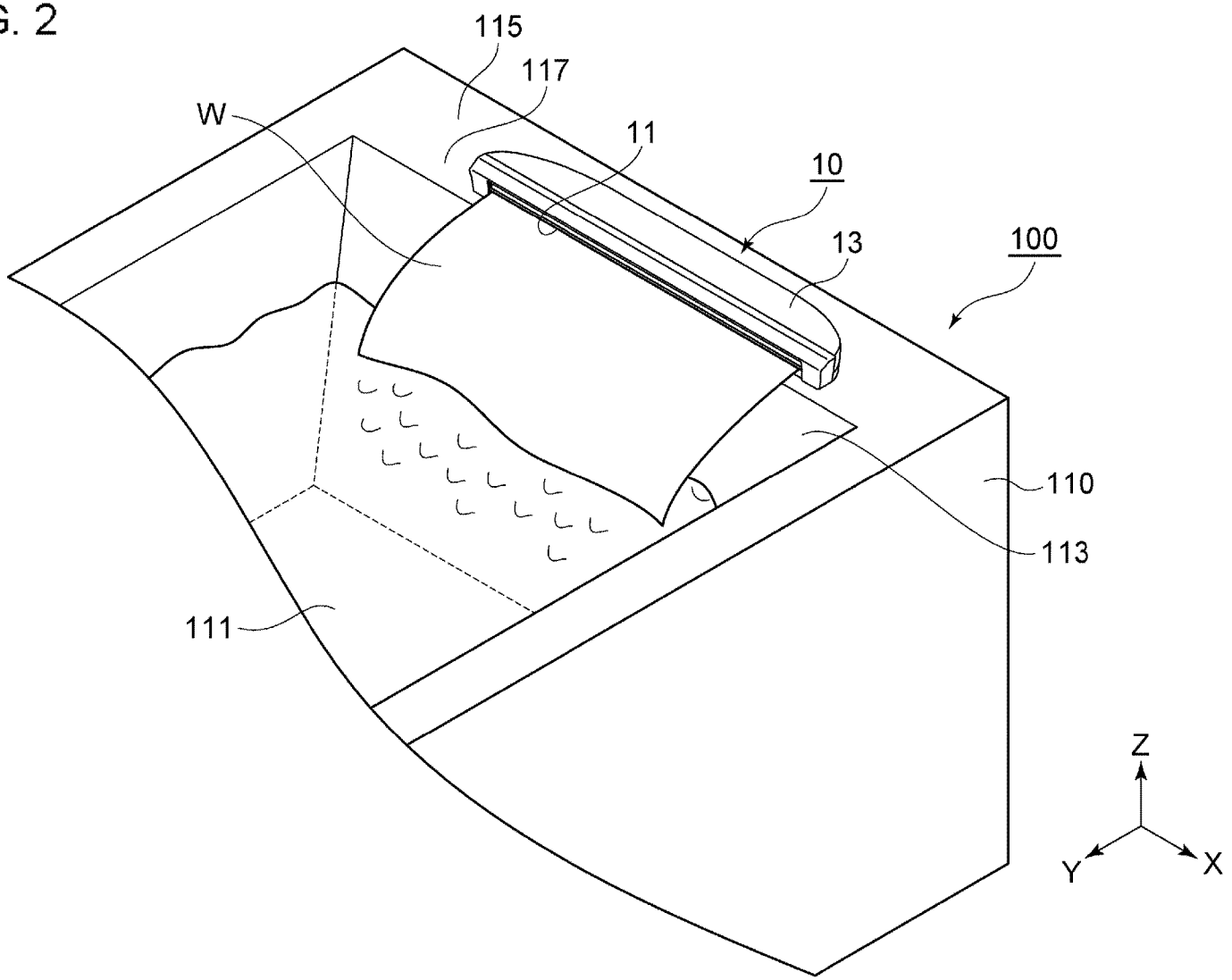
FIG. 2 is a perspective view illustrating a usage state of a water discharge device according to a first embodiment.

FIG. 2 is a perspective view illustrating a usage state of a water discharge device 10 according to the first embodiment. The water discharge device 10 is used for a bathtub fitting 100. The bathtub fitting 100 includes a bathtub 110 in addition to the water discharge device 10. The bathtub 110 is formed in a box shape of which an upper side is open, and bathtub water 111 is accumulated in the bathtub 110. An inner surface of the bathtub 110 is provided with a backside surface 113 with which a back of a bather comes into contact when the bather takes a bathing posture. In the bathtub 110, an installation surface 117 is provided on a rim portion 115 which is above the backside surface 113, and the water discharge device 10 is provided on the installation surface 117.

Figure 3:
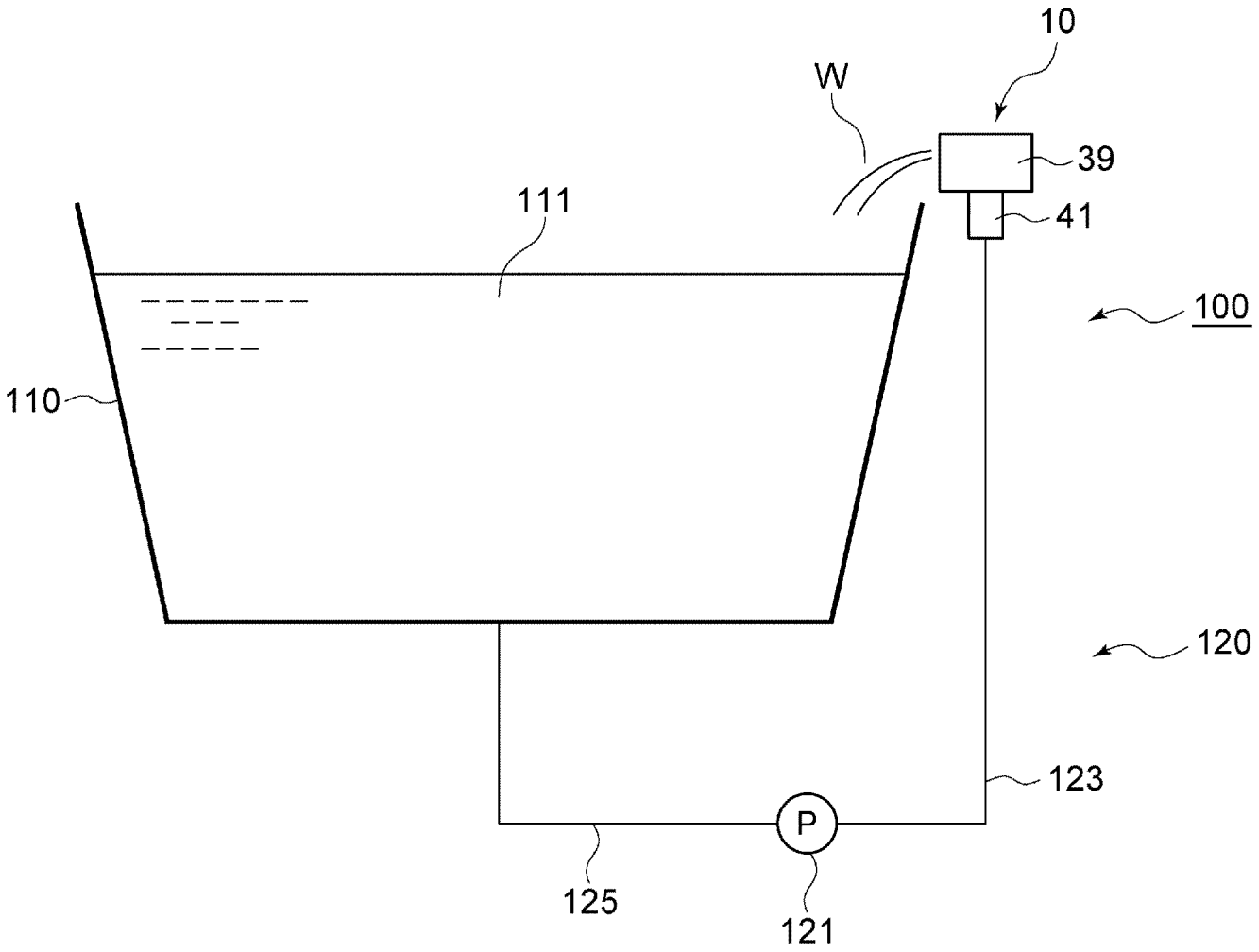
FIG. 3 is a configuration diagram illustrating a water supply system used for the water discharge device according to the first embodiment.

FIG. 3 is a configuration diagram illustrating a water supply system 120 used for the water discharge device 10. The water supply system 120 includes a water supply pump 121 provided on an upstream side of the water discharge device 10. The water supply pump 121 is connected to a water guiding portion 41 (explained later) of the water discharge device 10 via a discharge-side conduit 123, and is connected to the bathtub 110, which serves as a water supply source, via a suction-side conduit 125. When the water supply pump 121 is driven, the water supply pump 121 sucks the bathtub water 111 in the bathtub 110 through the suction-side conduit 125, and pumps water to the water guiding portion 41 of the water discharge device 10 through the discharge-side conduit 123. When water is pumped to the water guiding portion 41, the water discharge device 10 discharges film-like water W from a main body portion 39 (explained later).

Figure 4:
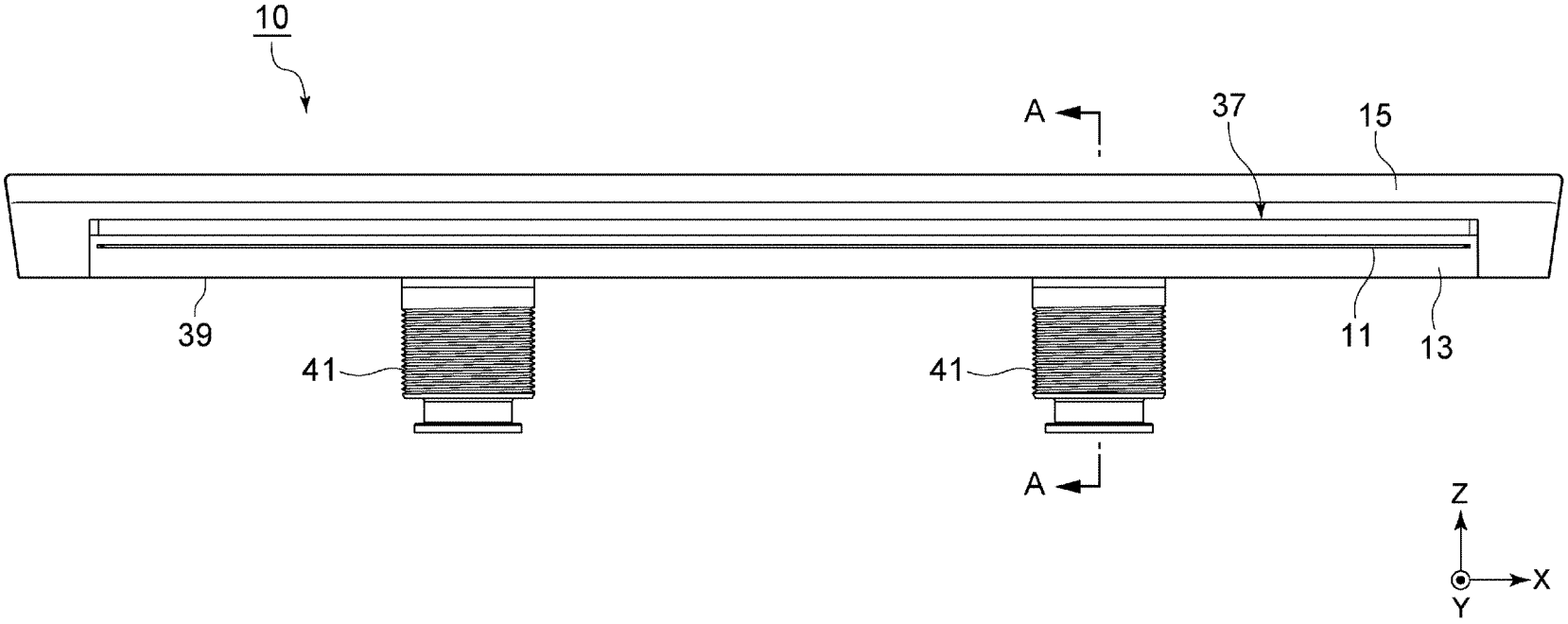
FIG. 4 is a front view illustrating the water discharge device according to the first embodiment.

FIG. 4 is a front view illustrating the water discharge device 10. The water discharge device 10 includes a water discharge member 13 formed with a slit-like discharge port 11, and discharges the film-like water forward from the discharge port 11. In the following explanation, a direction in which the discharge port 11 extends will be referred to as a left-and-right direction X, a horizontal direction perpendicular thereto will be referred to as a front-and-rear direction Y, and a vertical direction will be referred to as an up-and-down direction Z.

Figure 5:
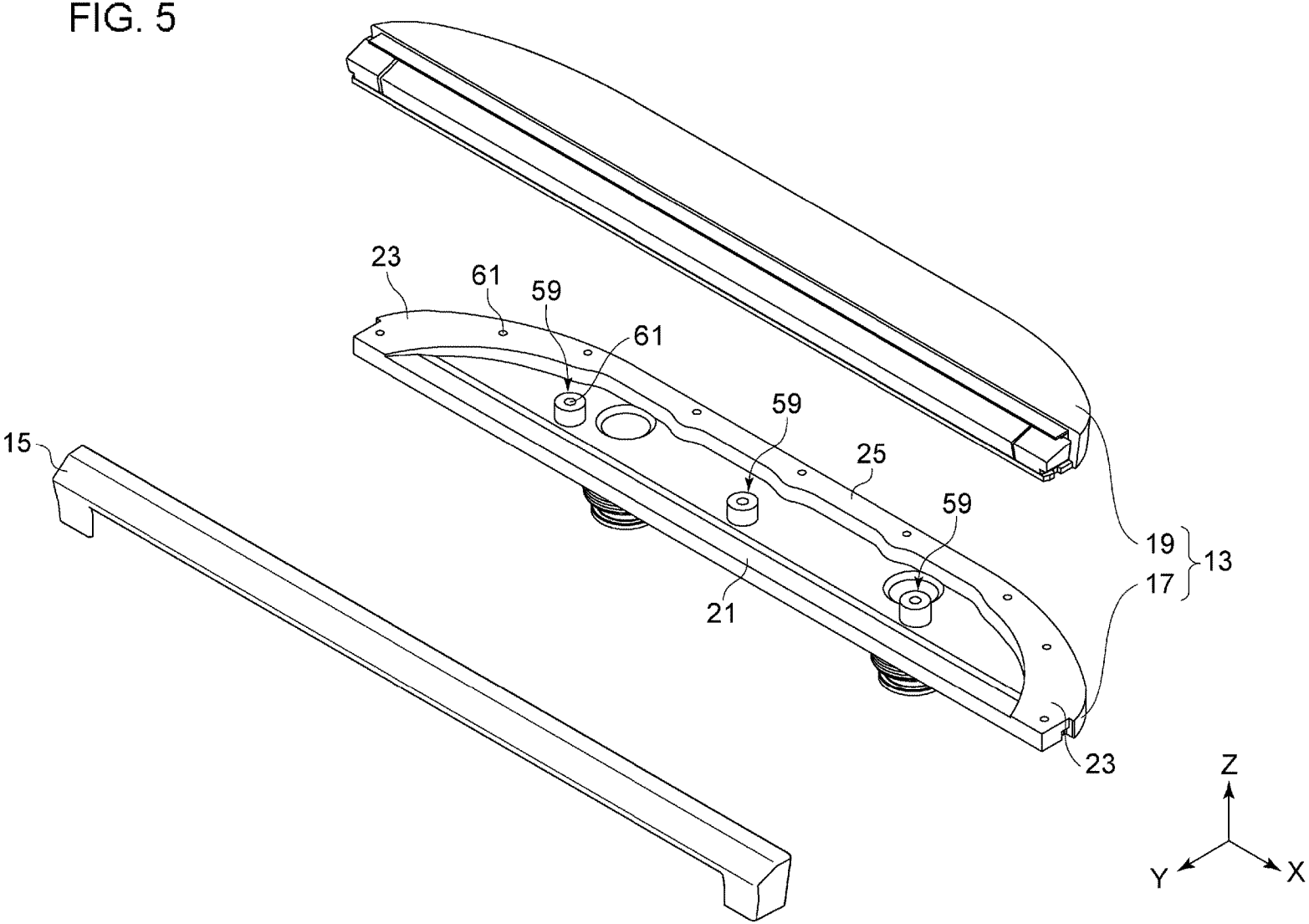
FIG. 5 is an exploded perspective view illustrating the water discharge device according to the first embodiment.

FIG. 5 is an exploded perspective view illustrating the water discharge device 10. The water discharge device 10 includes a water discharge member 13 and an exterior cover 15. The water discharge member 13 is constituted by assembling a lower-side division member 17 and an upper-side division member 19. Each of the division members 17, 19 has a shape obtained by dividing the water discharge member 13 in the up-and-down direction Z.

Figure 6:
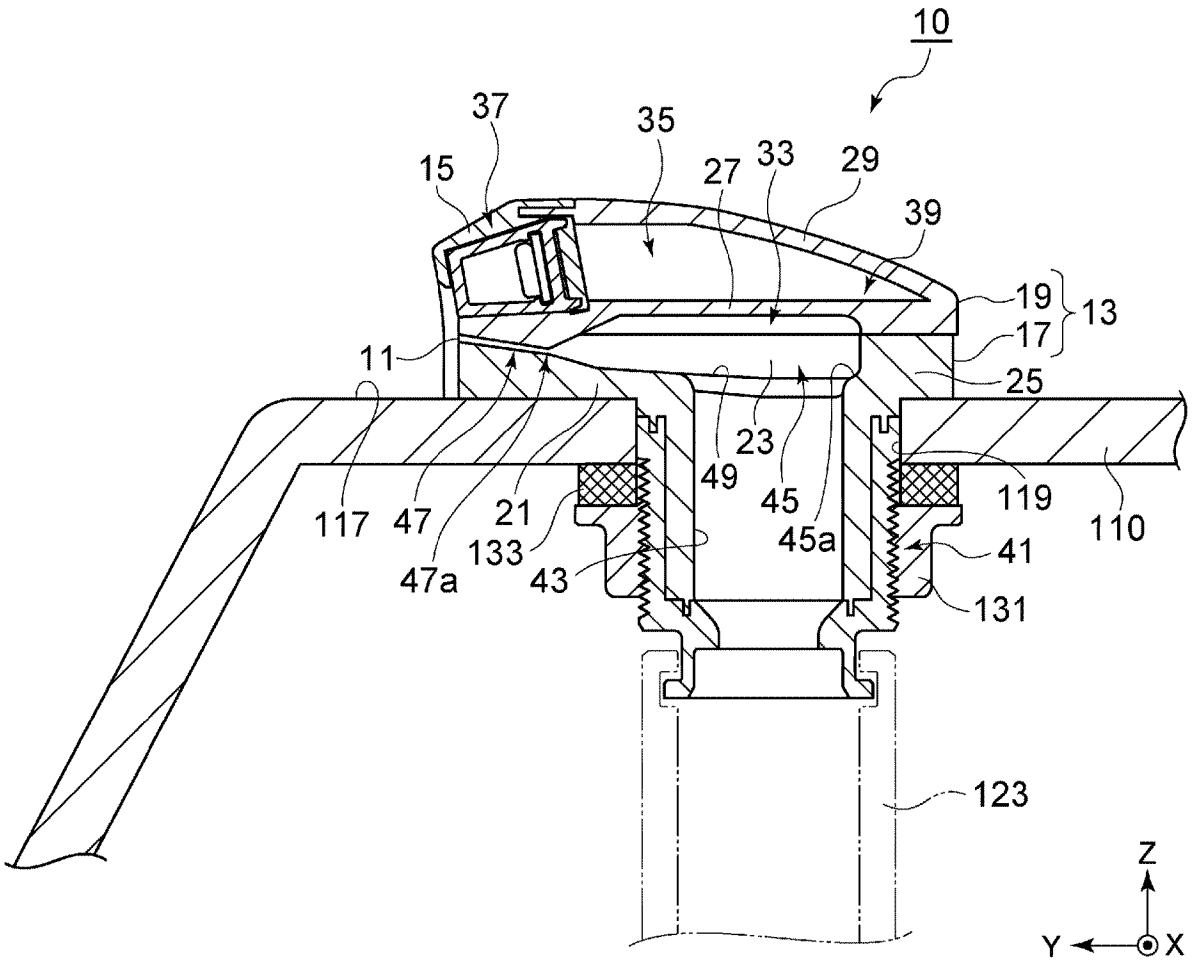
FIG. 6 is a sectional side view illustrating a usage state of the water discharge device according to the first embodiment.

FIG. 6 is a sectional side view illustrating a usage state of the water discharge device 10. This drawing is a cross sectional view taken along a line A-A of FIG. 4. In this drawing, a pillar-shaped portion 59 explained later is not described. As illustrated in FIGS. 5 and 6, the lower-side division member 17 includes a lower wall portion 21, a pair of side wall portion 23, and a rear wall portion 25. The lower wall portion 21 is placed on the installation surface 117. The side wall portions 23 rise from either lateral side portion of the lower wall portion 21, and the rear wall portion 25 rises from a rear portion of the lower wall portion 21.

As shown in FIG. 6, the upper-side division member 19 includes a first upper wall portion 27 and a second upper wall portion 29. The first upper wall portion 27 is disposed above the lower wall portion 21, and comes into contact with the side wall portions 23 and the rear wall portion 25 from above. A second upper wall portion 29 is disposed above the first upper wall portion 27, and a hollow space 35 is provided between each of the upper wall portions 27, 29.

An illumination device 37 is attached on the front portion of the upper-side division member 19. The illumination device 37 projects forward colored light and white light having predetermined wavelengths. These colored light and the like are projected to the film-like water, the bather, and the like, so that a preferable visual effect can be obtained. The exterior cover 15 covers the illumination device 37 from above, and is attached on the upper-side division member 19 so as to cover a portion of the water discharge member 13 from frontward.

The lower-side division member 17 and the upper-side division member 19 are detachably assembled with a fastener such as a screw, not shown. As shown in FIG. 5, the fasteners are inserted into insertion holes 61 formed on the side wall portion 23 and the rear wall portion 25 of the lower-side division member 17, and formed on pillar-shaped portions 59 protruding from the lower wall portion 21 toward the upper-side division member 19. End portions of the fasteners are attached on the upper-side division member 19.

As illustrated in FIG. 6, the water discharge member 13 includes a main body portion 39 and a water guiding portion 41. The main body portion 39 is constituted by the wall portions 21, 23, 25 of the lower-side division member 17 and the first upper wall portion 27 of the upper-side division member 19. The main body portion 39 is placed on the installation surface 117, and is formed to be flat so as to extend in the left-and-right direction X. The water guiding portions 41 protrude from the main body portion 39, and are disposed with a distance in the left-and-right direction X (see FIG. 4).

The water guiding portion 41 is inserted into an insertion hole 119 formed on the installation surface 117 of the bathtub 110. Inside the water guiding portion 41, a water guiding path 43 for supplying water to its downstream side is formed, and the discharge-side conduit 123 is connected to an end portion of the water guiding portion 41. A fixing member 131 such as a nut is attached, by means of screwing and the like, to a portion of the water guiding portion 41 which is protruding to the side opposite to the installation surface 117. The water discharge device 10 is fixed to the bathtub 110 by sandwiching the bathtub 110 between the main body portion 39 and the fixing member 131. It should be noted that a seal member 133 such as a gasket is interposed between the fixing member 131 and the bathtub 110.

The main body portion 39 is formed with the discharge port 11 which is opened on the front side thereof and the discharge path 33 for delivering water to the discharge port 11. The discharge port 11 and the discharge path 33 are formed between the lower-side division member 17 and the upper-side division member 19. More specifically, the discharge port 11 and the discharge path 33 are formed to be enclosed by the wall portions 21, 23, 25 of the lower-side division member 17 and the first upper wall portion 27 of the upper-side division member 19.

Figure 7A:
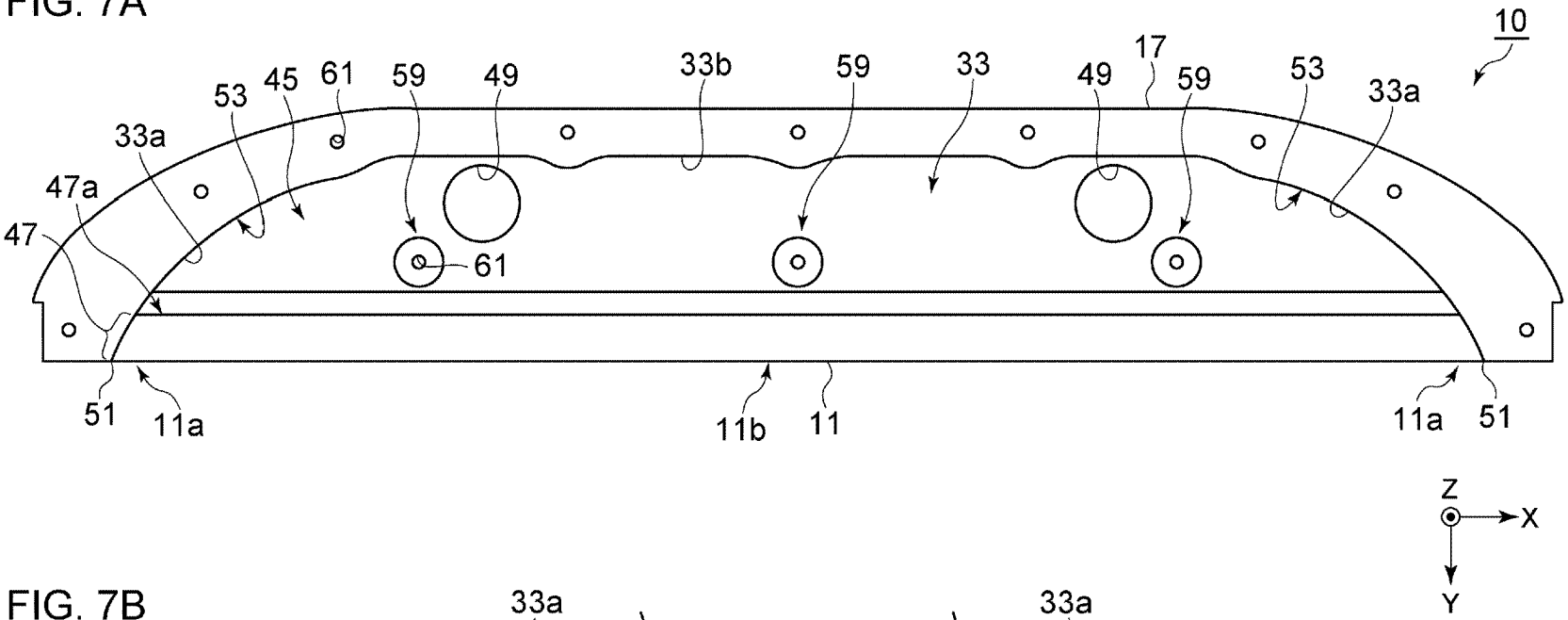
FIG. 7A is a plan view illustrating a discharge port and a discharge path of the water discharge device according to the first embodiment.

FIG. 7A is a plan view illustrating the discharge port 11 and the discharge path 33. This drawing is also a plan view of the lower-side division member 17. In a plan view, the discharge port 11 is formed to extend straightly in the left-and-right direction X. In a plan view, the discharge path 33 is formed to be flat so as to extend in the left-and-right direction X.

The discharge path 33 makes the discharge port 11 communicate with the inlet 49 to which the water is provided from the water guiding path 43. As shown in FIGS. 6A, 6B, 7A and 7B, the discharge path 33 is formed with a reservoir chamber 45 and a constricting flow path 47. Multiple inlets 49 are formed on a lower surface 45*a* of the reservoir chamber 45, which serves as an inner wall surface of the reservoir chamber 45. When water flows into the reservoir chamber 45 through the inlets 49 from the water guiding path 43, which serves as an upstream side, the water is temporarily held in the reservoir chamber 45 as reserve water.

The constricting flow path 47 is provided at the downstream side with respect to the reservoir chamber 45, and makes the reservoir chamber 45 communicate with the discharge port 11. The constricting flow path 47 is formed such that, as may be understood from FIG. 6, its path height is constant and is smaller than the path height of the reservoir chamber 45. The reserve water in the reservoir chamber 45 is sent forth to the discharge port 11 via the constricting flow path 47. The reserve water increases its velocity by being constricted when passing through the constricting flow path 47. As a result, the reserve water is powerfully discharged from the discharge port 11.

As shown in FIG. 7A, lateral surfaces 33*a* on either side of the discharge path 33 in the width direction are formed such that a path width of the discharge path 33 spreads as approaching its discharge port 11 side from its reservoir chamber 45 side. More specifically, each of the lateral surfaces 33*a* is formed such that a path width of the discharge path 33 continuously spreads within an area extending to the discharge port 11 from a depth surface 33*b* of the discharge path 33, being depth-ward of the discharge port 11.

Figure 7B:
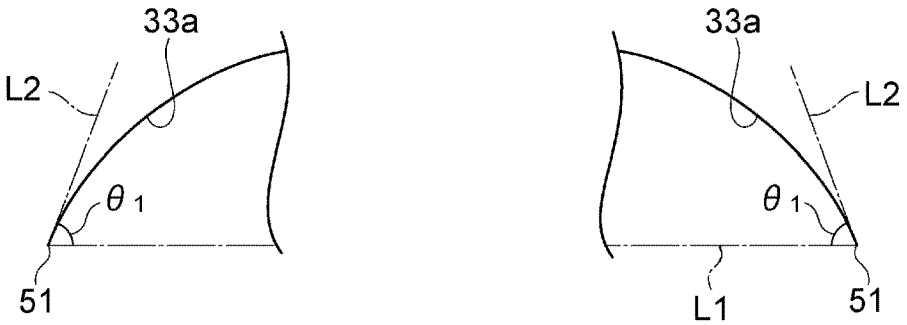
FIG. 7B is a view illustrating a part of lateral surfaces on either side of a discharge path in a width direction.

FIG. 7B is a figure illustrating parts of the lateral surfaces 33*a* on either side of the discharge path 33 in the width direction. An imaginary line paralleling the width direction of the discharge port 11 will be referred to as L1, and, on the lateral surface 33*a* of the discharge path 33, a tangent line passing over an opening rim 51 of the discharge port 11 will be referred to as L2. This imaginary line L1 is a line paralleling the left-and-right direction X, i.e., the width direction of the discharge port 11, and passing over the opening rims 51 on either side of the discharge port 11 in the width direction. In this case, the lateral surface 33*a* of the discharge path 33 is formed such that an angle θ1, which is formed by the imaginary line L1 and the tangent line L2, is acute and greater than or equal to 45° and less than 90°. The reason for this will be explained hereinafter.

Figure 8A:
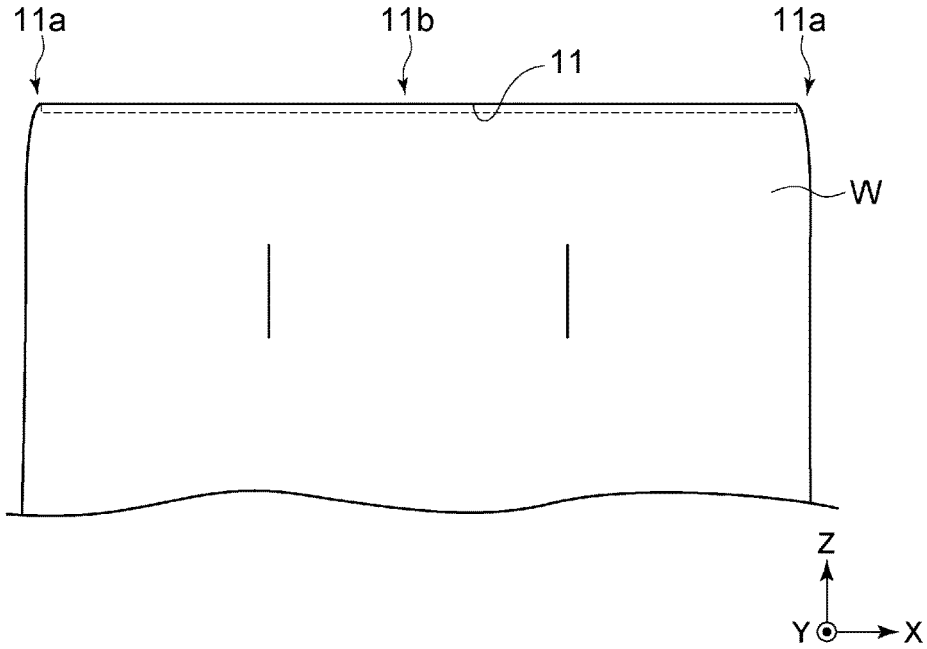
FIG. 8A is a front view schematically illustrating film-like water.
Figure 8B:
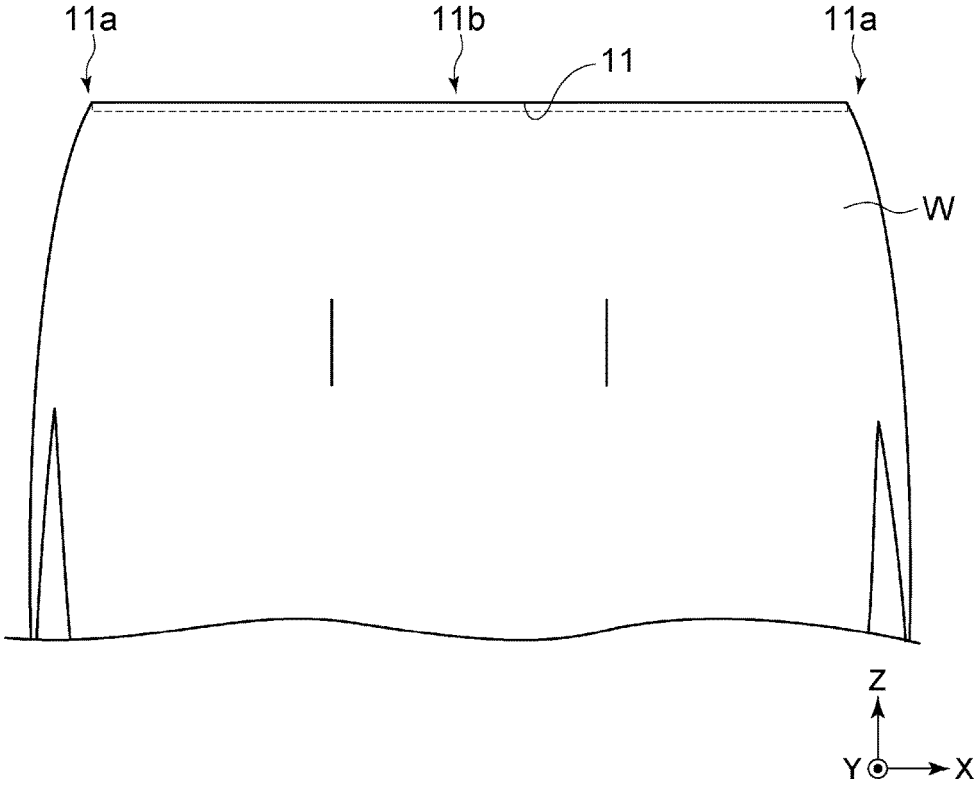
FIG. 8B is a front view schematically illustrating other film-like water.

FIGS. 8A, 8B are front views schematically illustrating the film-like water W discharged from the discharge port 11. If the angle θ1 is less than 90°, when the reserve water in the reservoir chamber 45 is discharged from the discharge port 11 through the constricting flow path 47, a water flow flows along the lateral surfaces 33*a* of the discharge path 33, and the velocity component directed to the outer side of the width direction is included in a water flow discharged from either end portion 11*a* of the discharge port 11 in the width direction. As a result, as shown in FIG. 8A, the time when the film-like water W starts to become narrow due to the surface tension can be delayed, and narrowness of the film-like water W can be easily suppressed within a wide area from where water is discharged from the discharge port 11 to where water comes into contact with the water surface.

Meanwhile, as a result of experimental considerations by the inventors of the present application, if the angle θ1 is less than 45°, there was a case that the film-like water W discharged from the discharge port 11 was divided in the width direction as shown in FIG. 8B. This may be because the velocity component, directed to the outer side of the width direction, of the water flow discharged from either end portion 11*a* of the discharge port 11 in the width direction becomes excessively large, and a water flow discharged from either end portion 11*a* of the discharge port 11 in the width direction is likely to be separated from a water flow discharged from a middle portion 11*b* in the width direction. The inventors of the present application have found that, if this angle θ1 is greater than or equal to 45°, separation of the film-like water W in the width direction can be suppressed easily. Therefore, the angle has been defined as described above.

Back to FIG. 7, lateral surfaces 33*a* on either side of the discharge path 33 are formed by arcuate portions 53 that bend drawing near inner sides of the width direction as it approaches the discharge port 11 from a depth surface 33*b* of the discharge path 33. This depth surface 33*b* is provided as a wall surface for sectioning the reservoir chamber 45 of the discharge path 33. The arcuate portion 53 is provided within a range from a position where the arcuate portion 53 is connected to the depth surface 33*b* of the discharge path 33 to the discharge port 11. The reason for this will be explained hereinafter.

Figure 9A:
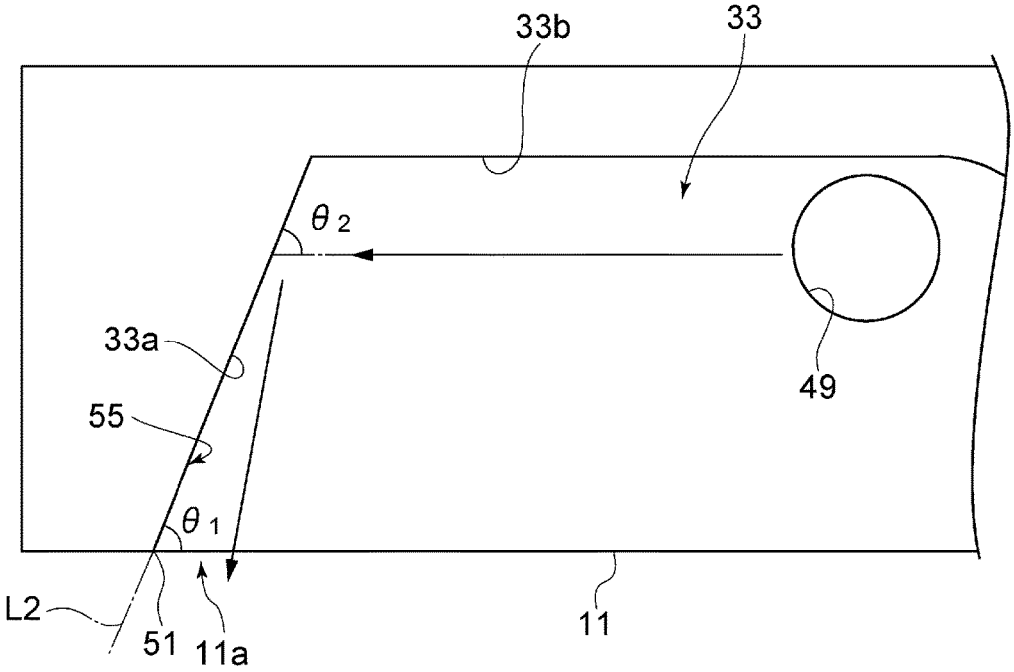
FIG. 9A is a view illustrating a water flow when lateral surfaces of a discharge path are formed by straight-line portions.

FIG. 9A is a figure illustrating a part of a water flow when the lateral surface 33*a* of the discharge path 33 is formed by a straight-line portion 55. This drawing is shown as a modification of the present invention. The straight-line portion 55 is formed to extend straightly from the depth surface 33*b* of the discharge path 33 to the discharge port 11. In this modification, the angle θ1 formed by the lateral surface 33*a* of the discharge path 33 is also formed to be greater than or equal to 45° and less than 90°, and therefore, the separation of the film-like water W can be easily suppressed while the narrowness of the film-like water W is suppressed.

A part of a water flow flowing from the inlet 49 flows in the left-and-right direction X at the depth side in the discharge path 33. In this case, with shape as illustrated in FIG. 9A, this water flow collides with the lateral surface 33*a* of the discharge path 33 with a relatively large angle θ2.

Figure 9B:
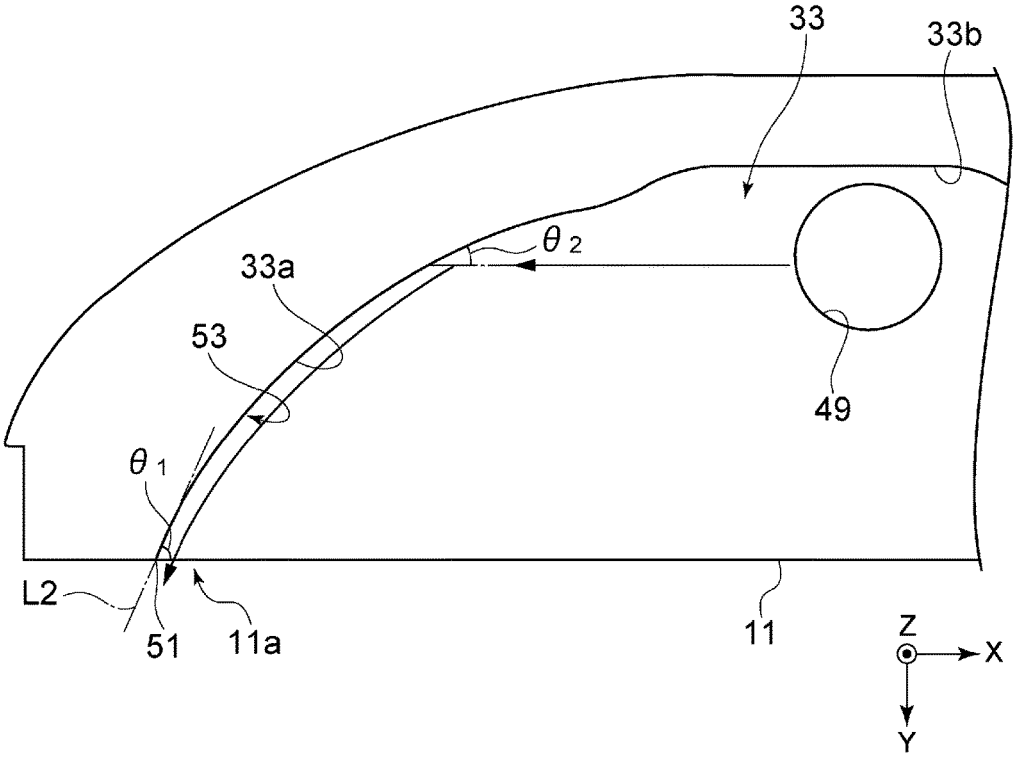
FIG. 9B is a figure illustrating a water flow when lateral surfaces of a discharge path are formed by arcuate portions.

FIG. 9B is a figure illustrating a part of a water flow when the lateral surface 33*a* of the discharge path 33 is formed by an arcuate portion 53. In this case, a water flow flowing in the left-and-right direction X at the depth-side in the discharge path 33 is such that, as flowing at the more depth-side in the discharge path 33, the angle θ2 with which the water flow collides with the lateral surface 33*a* of the discharge path 33 decreases as compared with the case where the lateral surface 33*a* of the discharge path 33 is formed to be straight (see FIG. 9A). For this reason, the water flow flowing in the left-and-right direction X at the depth-side in the discharge path 33 is such that, even when the water flow collides with the lateral surface 33*a* of the discharge path 33, the velocity of the water flow is less likely to decrease, and the water flow can be easily guided along the lateral surface 33*a* of the discharge path 33 with maintaining its force. As a result, a water flow can be easily discharged along the tangent line L2 from the end portion 11*a* of the discharge port 11 in the width direction, and from there, a water flow including the velocity component directed to the outer side in the width direction can be easily discharged. Therefore, as compared with the case where the lateral surface 33*a* of the discharge path 33 is formed by the straight-line portion 55, a water flow can be more easily discharged along the tangent line L2 from the end portion 11*a* of the discharge port 11 in the width direction, and the narrowness of the film-like water can be easily suppressed with stability.

With the water discharge member 13 according to the above embodiment, water pumping from the water supply pump 121 (see FIG. 3) flows through the water guiding path 43, flows into the reservoir chamber 45 from the inlet 49, and is temporarily held in the reservoir chamber 45 as reserve water. By sending forth water from the inlet 49 in a state of holding the reserve water in the reservoir chamber 45, the reserve water in the reservoir chamber 45 is pressurized. With such water pressure, the reserve water is sent forth to the discharge port 11 through the constricting flow path 47, and film-like water is discharged from the discharge port 11.

Here, water flowing in from the inlet 49, which serves an upstream side, flows so as to spread toward an entrance 47*a* of the constricting flow path 47 from the inlet 49. A velocity of the water flow decreases when this water flow flows through the reservoir chamber 45. In addition, until the water flow reaches to the entrance 47*a* (see FIG. 6) of the constricting flow path 47 from the inlet 49, the water flow has been effectively straightened such that a velocity of the water flow becomes uniform in the width direction. As a result, a velocity of a water flow discharged from the discharge port 11 can be more easily made uniform in the width direction, and form loss of the film-like water can be suppressed.

The discharge path 33 is formed such that a path width of the discharge path 33 spreads as approaching its discharge port side from depthward of the discharge port 11, and therefore, narrowness of the film-like water can be more easily suppressed. In particular, because the angle θ1 formed by the lateral surface 33*a* of the discharge path 33 is greater than or equal to 45° and less than 90°, separation of the film-like water can be easily suppressed while the narrowness of the film-like water is suppressed. Therefore, form loss of the film-like water discharged from the discharge port 11 is suppressed, and it becomes possible to discharge the film-like water with superior appearance.

It should be noted that a width length of the discharge port 11 is not particularly limited. According to findings of the inventors of the present application, with a conventional water discharge device, the film-like water is likely to lose its form when, for example, the width length becomes greater than or equal to 150 mm. Therefore, when the present invention is applied to a water discharge device in which the width length of the discharge port 11 is greater than or equal to 150 mm, form loss of the film-like water can be more particularly effectively suppressed.

Second Embodiment

Figure 10A:
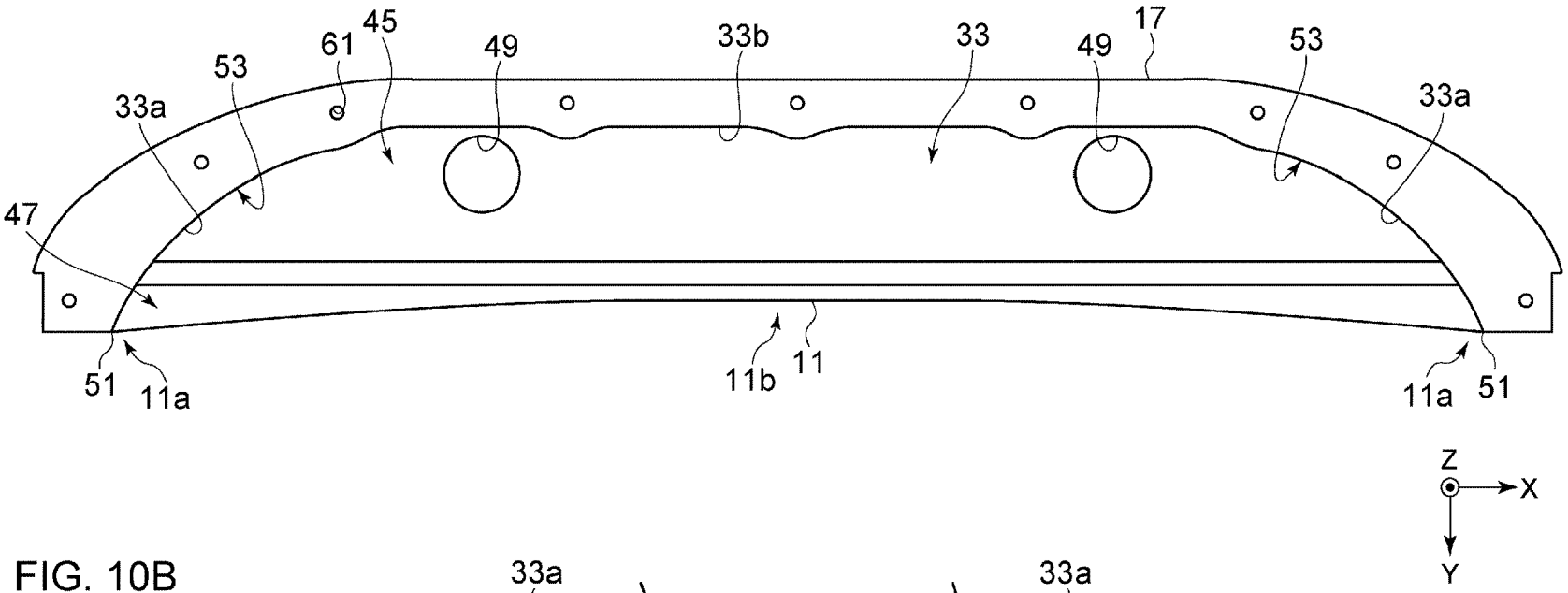
FIG. 10A is a plan view illustrating a discharge port and a discharge path of a water discharge device according to a second embodiment.
Figure 10B:
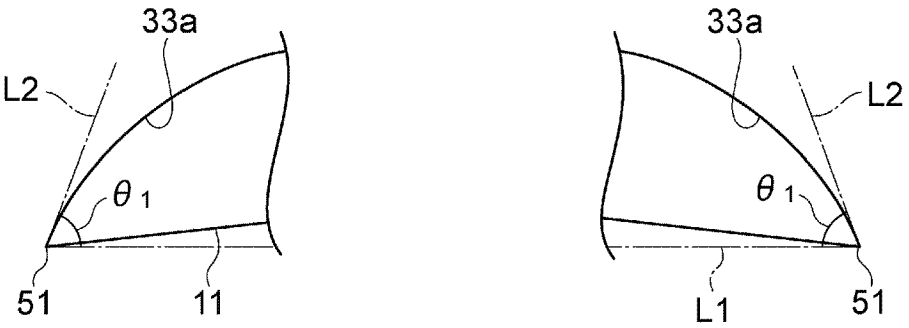
FIG. 10B is a view illustrating a part of lateral surfaces on either side of a discharge path in a width direction.

FIG. 10A is a plan view illustrating a discharge port 11 and a discharge path 33 of a water discharge device 10 according to the second embodiment, and FIG. 10B is a figure illustrating lateral surfaces 33*a* on either side of the discharge path 33 and a part of the discharge port 11. In the following explanation, elements common to those of the first embodiment will be denoted with the same reference numerals, and an explanation thereabout is omitted.

In a plane view, the discharge port 11 is formed in an arch shape that bend so as to be depressed directed to the depth-side of the discharge port 11. Also in the present embodiment, the lateral surfaces 33*a* on either side of the discharge path 33 in the width direction are formed such that the angle θ1 formed by the imaginary line L1 and the tangent line L2 is acute and greater than or equal to 45° and less than 90°. Also in the present embodiment, like the first embodiment, form loss of the film-like water discharged from the discharge port 11 can be easily suppressed. As described above, the discharge port 11 may be formed in a slit shape, and the shape thereof is not particularly limited.

Third Embodiment

Figure 11A:
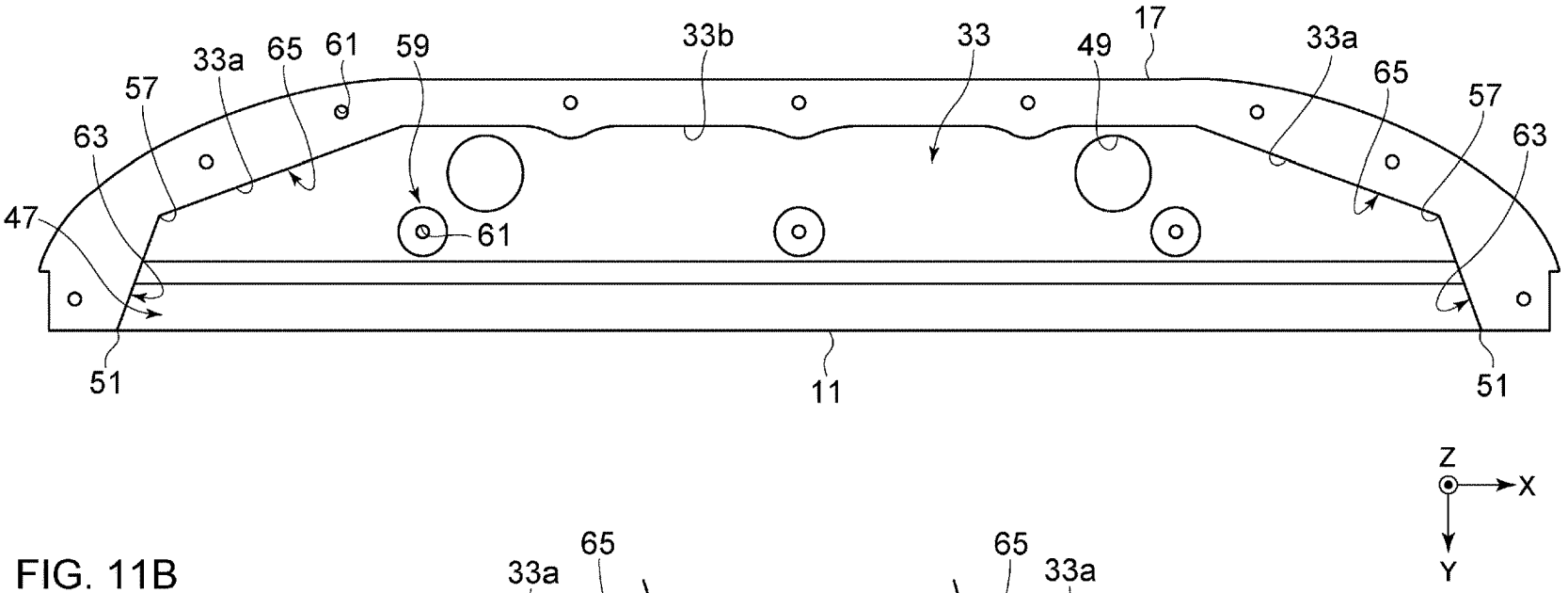
FIG. 11A is a plan view illustrating a discharge port and a discharge path of a water discharge device according to a third embodiment.
Figure 11B:
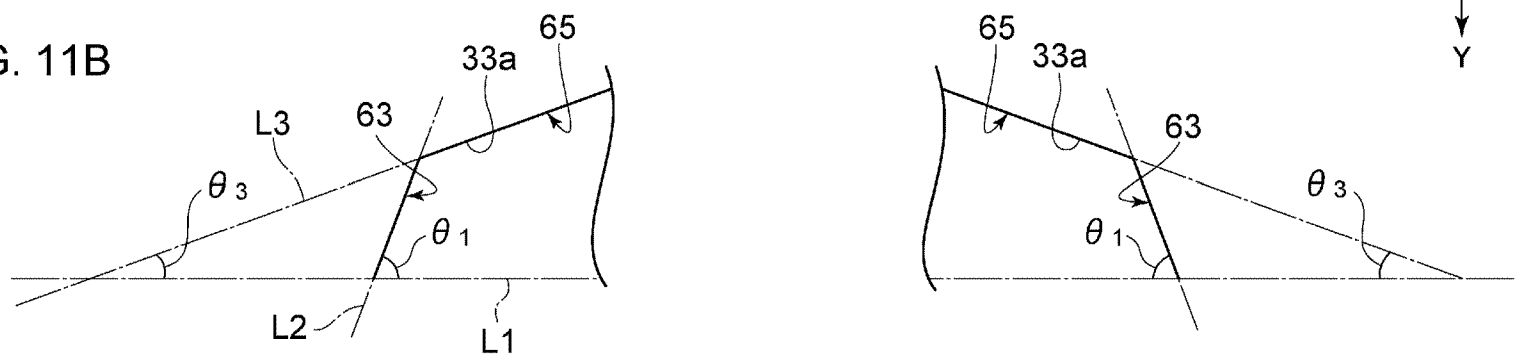
FIG. 11B is a view illustrating a part of lateral surfaces on either side of a discharge path in a width direction.

FIG. 11A is a plan view illustrating a discharge port 11 and a discharge path 33 of a water discharge device 10 according to a third embodiment. FIG. 11B is a figure illustrating a part of lateral surfaces 33*a* of the discharge path 33. The lateral surfaces 33*a* on either side of the discharge path 33 in the width direction are formed by an entry-side surface portion 63 and a depth-side surface portion 65. The entry-side surface portion 63 is provided so as to continue from the opening rim 51 at the discharge port's side in the discharge path 33. The depth-side surface portion 65 is provided at the discharge port's depth side of the entry-side surface portion 63. Each of the surface portions 63, 65 is formed to be straight such that a path width narrows as approaching the depth surface 33*b* of the discharge path 33 from the discharge port 11. The surface portions 63, 65 are formed such that a border portion 57 thereof protrudes toward the outer side in the width direction. The surface portions 63, 65 are formed such that an angle θ3 formed by an imaginary line L1 and a tangent line L3 passing over the depth-side surface portion 65 is less than an angle θ1 formed by the imaginary line L1 and a tangent line L2 passing over the entry-side surface portion 63.

Also in the present embodiment, the lateral surfaces 33*a* on either side of the discharge path 33 in the width direction is formed such that the angle θ1 formed by the imaginary line L1 and the tangent line L2 is greater than or equal to 45° and less than 90°. Therefore, also in the present embodiment, form loss of the film-like water discharged from the discharge port 11 can be easily suppressed.

And also in the water discharge device 10 according to the present embodiment, a water flow flowing in the left-and-right direction X at the discharge path's depth-side is such that an angle with which the water flow collides with the depth-side surface portion 65, which serves as the lateral surface 33*a* of the discharge path 33, decreases as compared with the case where the lateral surface 33*a* of the discharge path 33 is formed to be simply straight (see FIG. 9A). For this reason, the water flow flowing in the left-and-right direction X at the depth-side in the discharge path 33 is such that, even when the water flow collides with the lateral surface 33*a* of the discharge path 33, a velocity of the water flow is less likely to decrease, and a water flow can be easily guided along the lateral surface 33*a* of the discharge path 33 with maintaining its force. As a result, water flow along the tangent line L2 can be easily discharged from the end portion 11*a* of the discharge port 11 in the width direction, and narrowness of the film-like water can be easily suppressed with stability.

Figure 12A:
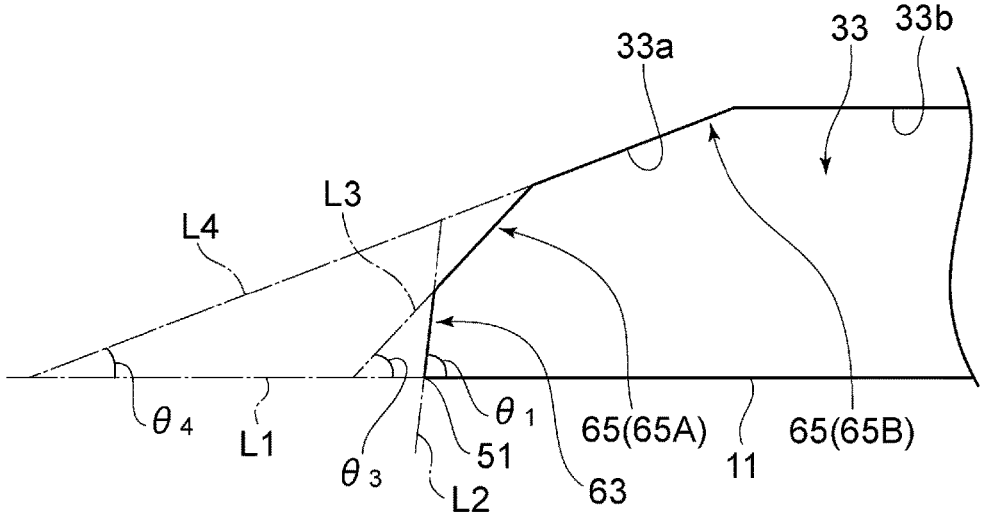
FIG. 12A is a plan view illustrating a discharge path of a water discharge device according to a first modification of the third embodiment.

In order to achieve the same operations and effects, following structures may be used. In the third embodiment, the lateral surface 33*a* of the discharge path 33 includes the single depth-side surface portion 65, but as shown in FIG. 12A, it may include multiple depth-side surface portions 65. The depth-side surface portions 65 include a first depth-side surface portion 65A provided at the depth-side of the entry-side surface portion 63 and a second depth-side surface portion 65B provided at the depth side of the first depth-side surface portion 65A. The depth-side surface portions 65A, 65B are formed such that an angle θ4 formed by the imaginary line L1 and a tangent line L4 passing over the second depth-side surface portion 65B is less than an angle θ3 formed by the imaginary line L1 and a tangent line L3 passing over the first depth-side surface portion 65A. In any case, the entry-side surface portion 63 and the depth-side surface portions 65 may be formed such that the angle formed by the imaginary line L1 and a tangent line passing over any surface portion that is more depth-ward than any other surface portion is smaller than the angle of the any other surface portion.

Figure 12B:
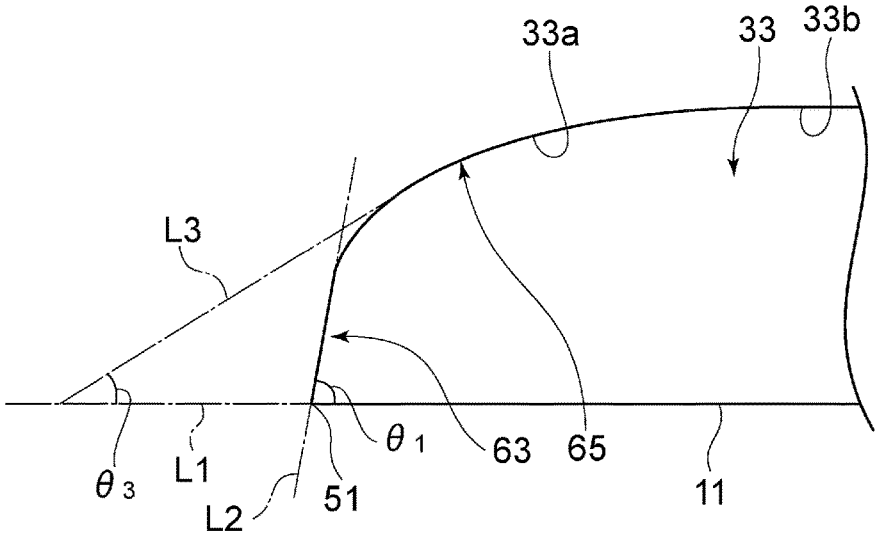
FIG. 12B is a plan view illustrating a discharge path of a water discharge device according to a second modification of the third embodiment.

The depth-side surface portion 65 of the discharge path 33 is formed to be straight in the third embodiment, but as shown in FIG. 12B, the depth-side surface portion 65 of the discharge path 33 may be formed in an arcuate shape that bend so as to narrow a path width as approaching the depth surface 33*b* of the discharge path 33 from the discharge port 11. In this case, an angle θ3 formed by the imaginary line L1 and the tangent line L3 passing over the depth-side surface portion 65 is less than the angle θ1 formed by the imaginary line L1 and the tangent line L2 passing over the entry-side surface portion 63. It should be noted that the entry-side surface portion 63 may be formed in an arcuate shape as with the depth-side surface portion 65.

While the preferred embodiments of the present invention have been described using specific terms, such description is for the purpose of only illustrating the principle and applications of the present invention, and it is to be understood that modifications or changes and variations in arrangement may be further made without departing from the spirit or scope of the appended claims that underlie the technical ideas of the present invention.

A description has been given of an example where a base body on which the water discharge device 10 is installed is the bathtub 110, but the specific configuration of the base body is not limited thereto. Alternatively, the water discharge device 10 may also be installed on, i.e., a washbasin of a washroom, a sink in a kitchen, and the like as the base body. In any case, the installation surface 117 may be provided on the base body, and the water discharge device 10 may be installed on the installation surface 117. A description has been given of an example where the installation surface 117 is provided on the rim portion 115 of the bathtub 110, but its position is not limited thereto.

The lower-side division member 17 and the upper-side division member 19 are detachably assembled with fasteners, but this should not be considered as limiting. The lower-side division member 17 and the upper-side division member 19 may also be assembled with a snap-fit and so on. The inlet 49 is formed on the lower surface 45*a* of the reservoir chamber 45, but the configuration is not limited as long as the inlet 49 is formed on an inner wall surface of the reservoir chamber 45. The inlet 49 may be formed on the depth surface 33*b* or the lateral surface.

EXAMPLES

Hereinafter, the effects of the present invention will be further explained with reference to examples. In the present examples, a form of the film-like water is checked by using water discharge devices according to the first to third comparative examples and the first to third invention examples explained below.

By referring the water discharge member 13 having the shape as illustrated in FIG. 7, water discharge members different in the angle θ1 were prepared, and they were used as the first to third comparative examples and the first and second invention examples. In the first to third invention examples, the angles θ1 of the both-lateral surfaces 33*a* of the discharge path 33 were 69°, 50°, 80°, respectively. In the first and second comparative examples, the angles θ1 of the lateral surface 33*a* of the discharge path 33 were 90° and 40°, respectively.

Figure 13:
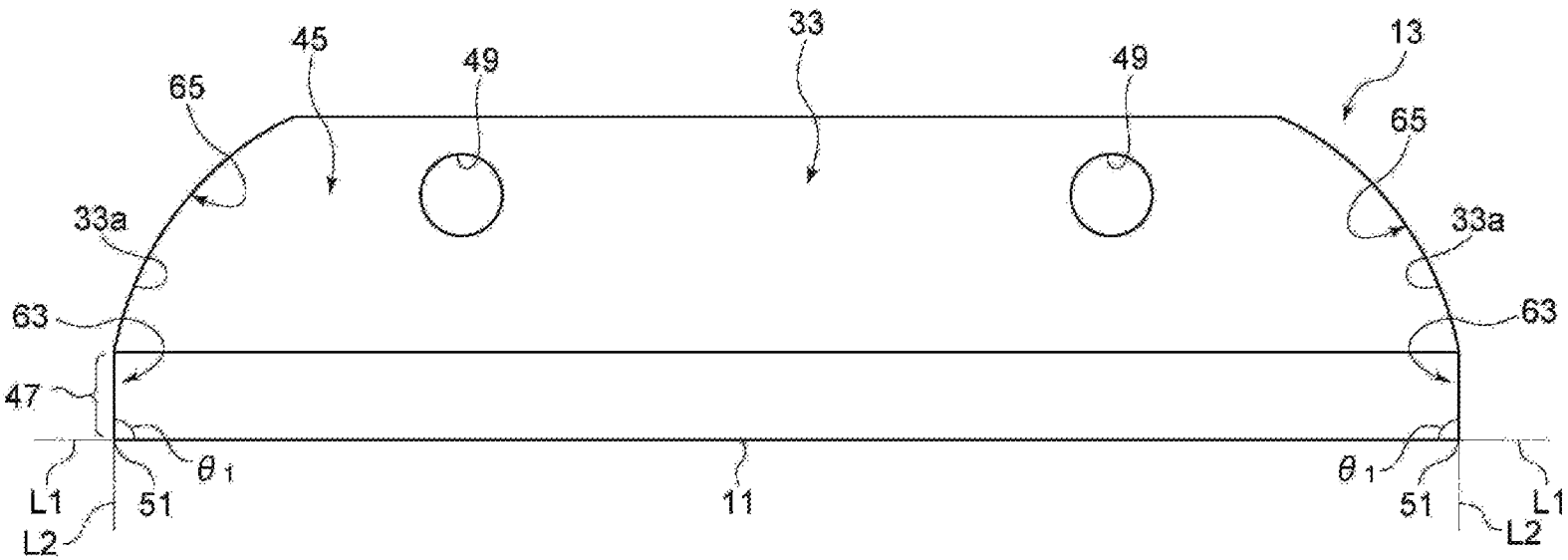
FIG. 13 is a plan view illustrating a discharge path of a water discharge device according to a third comparative example.

In addition, a water discharge member 13 having a discharge path 33 with a shape as illustrated in FIG. 13 was prepared, and this was used as a third comparative example (an example of a related technique). In the third comparative example, the lateral surface 33*a* of the discharge path 33 included a straight entry-side surface portion 63 continuing from an opening rim 51 of a discharge port 11 and an arc-shaped depth-side surface portion 65 provided at a depth-side in the discharge path 33. In the third comparative example, the angle θ1 of the entry-side surface portion 63 of the discharge path 33 was 90°.

In any example, the width length of the discharge port 11 was 435 [mm], and the height in the up-and-down direction was 1 [mm], and water was pumped into the inlets 49 from the water supply pump 121 under a condition where a supply rate was 33 [l/min].

As a result, in the first to third invention examples, it was found that any narrowness or separation could not be found in the film-like water, and form loss of the film-like water could be suppressed. On the other hand, in the first and third comparative examples, since the angle θ1 was 90°, the film-like water narrowed greatly. In the second comparative example, since the angle θ1 was 40° which is less than 45°, the film-like water was separated in the width direction.

When the invention realized by the above embodiments and modifications is generalized, the following technical concepts are derived. Hereinafter, explanation will be made by using the embodiments described in the Problems to be Solved by the Invention.

In the water discharge device according to the above embodiment, wherein the lateral surfaces on either side of the discharge path in the width direction may be formed by arcuate portions that bend drawing near inner sides of the discharge path in the width direction as it approaches the discharge port from a depth surface thereof, being depth-ward of the discharge port.

According to this embodiment, water flowing in from the upstream side can be easily guided to the discharge port along the lateral surface of the discharge path with maintaining its force. Therefore, a water flow along the tangent line passing over the opening rim can be easily discharged from the discharge port, and narrowness of the film-like water can be easily suppressed with stability.

In the water discharge device according to the above embodiment, the lateral surfaces on either side of the discharge path in the width direction may include an entry-side surface portion continuing from the discharge port's opening rim, and single or multiple depth-end surface portions provided depth-ward of the entry-side surface portions; and the entry-side surface portion and the depth-side surface portions may be formed such that the angle, being acute, formed by the imaginary line and a tangent line passing over any surface portion that is more depth-ward than any other surface portion is smaller than the acute angle of the any other surface portion.

According to this embodiment, water flowing in from the upstream side can be easily guided to the discharge port along the lateral surface of the discharge path with maintaining its force. Therefore, a water flow along the tangent line passing over the opening rim can be easily discharged from the discharge port, and narrowness of the film-like water can be easily suppressed with stability.

What is claimed is:

1. A water discharge device for discharging water in film form, comprising:

a water discharge member formed with a slit-like discharge port and a discharge path for delivering water to the discharge port, wherein the discharge path is formed with a reservoir chamber for holding, as reserve water, water flowing into the discharge path from its upstream side, and is formed with a constricting flow path that from a reservoir-chamber side thereof sends forth the reserve water in the reservoir chamber to the discharge port along a discharge-port side of the constricting flow path, the constricting flow path being of constant path height from its reservoir-chamber side to its discharge-port side, and lateral surfaces on either side of the discharge path in its width direction are formed such that a path width of the discharge path spreads as approaching its discharge port side from its reservoir chamber side, and is formed such that the angle formed by an imaginary line paralleling the width direction of the discharge port and, on the lateral surfaces, a tangent line passing over the discharge port's opening rim is acute and greater than or equal to 45° and less than 90°.

2. The water discharge device according to claim 1, wherein the lateral surfaces on either side of the discharge path in the width direction are formed by arcuate portions that bend drawing near inner sides of the discharge path in the width direction as it approaches the discharge port from a depth surface thereof, being depth-ward of the discharge port.

3. The water discharge device according to claim 1, wherein:

the lateral surfaces on either side of the discharge path in the width direction include an entry-side surface portion continuing from the discharge port's opening rim, and single or multiple depth-end surface portions provided depth-ward of the entry-side surface portions; and the entry-side surface portion and the depth-side surface portions are formed such that the angle, being acute, formed by the imaginary line and a tangent line passing over any surface portion that is more depth-ward than any other surface portion is smaller than the acute angle of the any other surface portion.

4. A bathtub fitting comprising:
the water discharge device according to claim 1; and
a bathtub on which the water discharge device is installed.

5. A bathtub fitting comprising:
the water discharge device according to claim 2; and
a bathtub on which the water discharge device is installed.

6. A bathtub fitting comprising:
the water discharge device according to claim 3; and
a bathtub on which the water discharge device is installed.

* * * * *